United States Patent [19]

Sundberg

[11] Patent Number: 4,820,558

[45] Date of Patent: Apr. 11, 1989

[54] DISPOSABLE CLEANING ARTICLE

[76] Inventor: Bo S. Sundberg, 791 44 Falun, Stjarnvagen, Sweden

[21] Appl. No.: 127,443

[22] Filed: Dec. 2, 1987

Related U.S. Application Data

[63] Continuation-in-part of Ser. No. 69,508, Jul. 2, 1987, abandoned.

[51] Int. Cl.[4] ..... A47L 13/18; A47L 13/38

[52] U.S. Cl. ..... 428/34.3; 15/104 A; 428/40; 428/136; 428/187; 428/35.2

[58] Field of Search ..... 15/104 A; 428/35, 40, 428/136, 187

[56] References Cited

U.S. PATENT DOCUMENTS

| | | | |
|---|---|---|---|
| Re. 25,675 | 11/1964 | du Bonnet | 15/104 A |
| 2,395,077 | 2/1946 | Southwick, Jr. | 428/131 X |
| 3,229,875 | 1/1966 | Stoller | 2/169 X |
| 3,321,790 | 5/1967 | Hand | 15/104 A |
| 3,329,985 | 7/1967 | Glowacki, Jr. | 15/104 A |
| 3,389,416 | 6/1968 | Timms | 15/104 A |
| 4,034,853 | 7/1977 | Smith | 428/906 X |
| 4,313,986 | 2/1982 | Magnotta | 428/40 |
| 4,510,640 | 4/1985 | Omori | 15/104 A |
| 4,515,841 | 5/1985 | Dyke | 428/35 |
| 4,713,274 | 12/1987 | Minor | 428/40 |
| 4,764,404 | 8/1988 | Genske et al. | 428/35 |

*Primary Examiner*—Henry F. Epstein

*Attorney, Agent, or Firm*—Merchant, Gould, Smith, Edell, Welter & Schmidt

[57] ABSTRACT

A disposable cleaning article for removing particulate matter from various materials especially clothing is disclosed. The cleaning article comprises two similarly shaped and aligned plastic sheets which are affixed to each other along the periphery of the sheets, thereby forming a pocket area between the plastic sheets. The affixed first and second plastic sheets have at least one opening to provide access to the pocket area in order to allow for manual direction of the cleaning article along a surface to be cleaned. One surface of the device is coated with an adhesive suitable for collecting particulate matter such as lint. A cover sheet is detachably secured to the adhesive material to protect the adhesive coated surface prior to use of the cleaning article.

15 Claims, 4 Drawing Sheets

FIG. 1
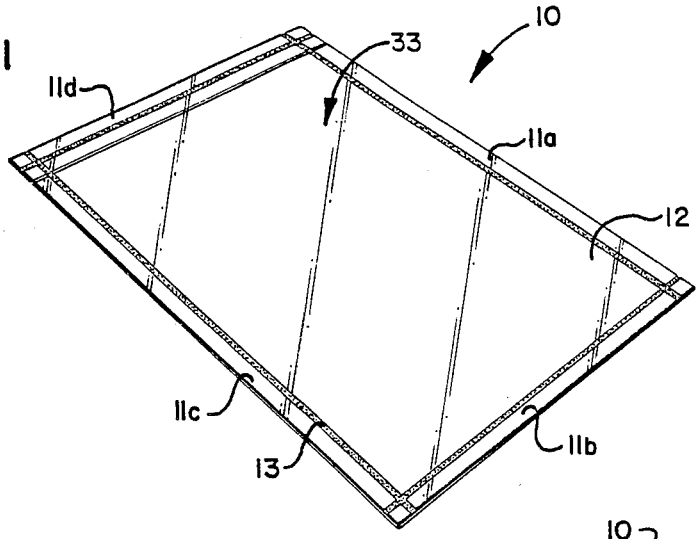
FIG. 2
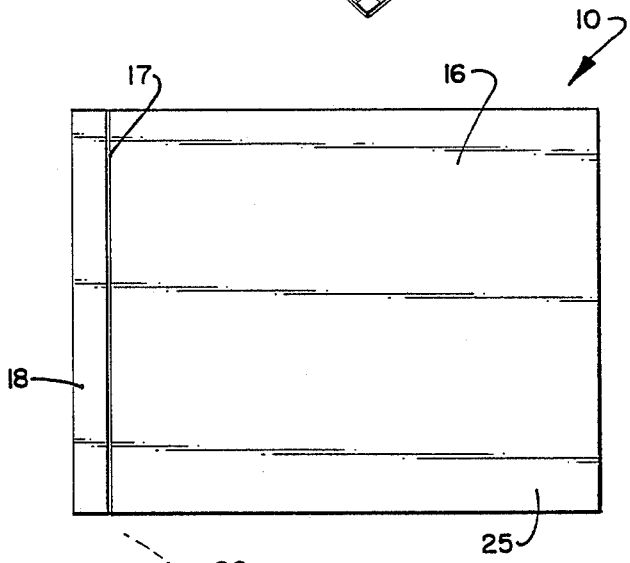
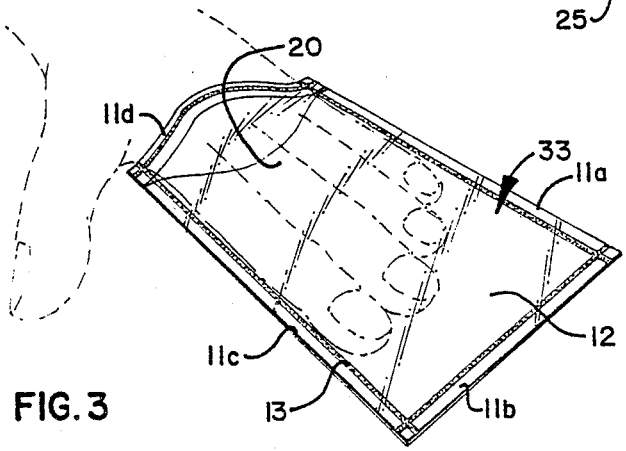
FIG. 3

FIG. 6
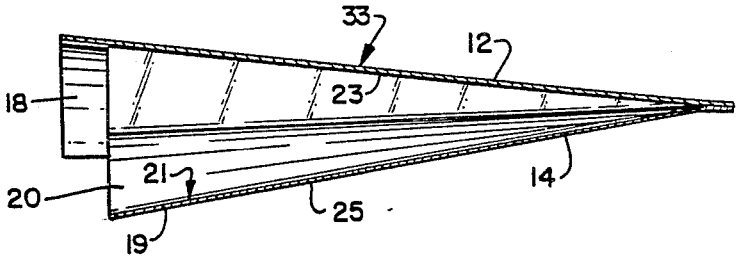
FIG. 7
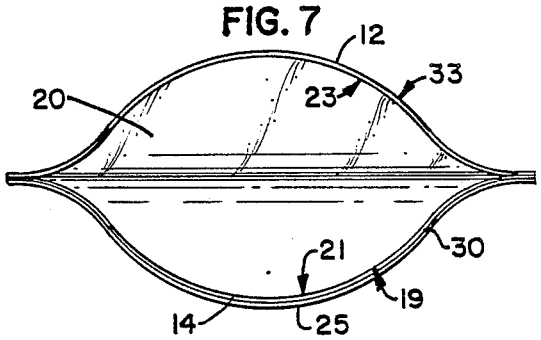
FIG. 8
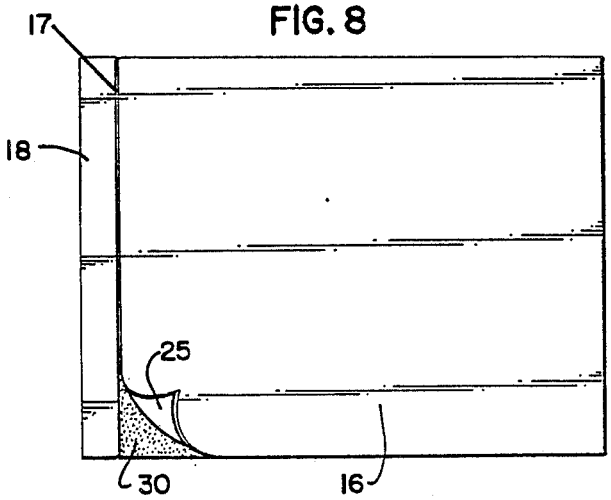
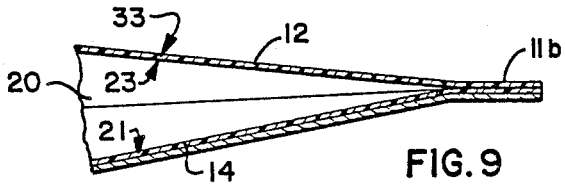
FIG. 9

DISPOSABLE CLEANING ARTICLE

CROSS-REFERENCE TO RELATED APPLICATION

This application is a continuation-in-part of co-pending application Ser. No. 69,508 filed July 2, 1987 and now abandoned.

TECHNICAL FIELD

The present invention relates to a disposable cleaning article. More particularly, the present invention relates to a disposable plastic article for removing particulate matter from material surfaces, especially items of clothing. Particulate matter such as lint is removed by contacting an adhesive bearing surface of the plastic article to the material to be cleaned.

BACKGROUND OF THE INVENTION

Currently, there are a number of articles on the market which are designed to remove particulate matter from material surfaces. To remove fibrous debris, such as short fibers of yarn and fabric (i.e. lint), from items of clothing a brush having bristles or an adhesive roller is typically employed.

While the lint brush is a common household object, it is not generally an item carried by travelers. In some cases a clothes cleaning article such as a lint brush is considered unnecessary or too bulky to pack. Additionally, the item may be simply forgotten during the packing process.

To eliminate the need for a traveler to purchase and/or transport a relatively expensive and in many cases bulky cleaning article such as a lint brush, there is a need for an effective low cost disposable cleaning article for removing particulate matter from clothing. Accordingly, the present invention meets this need by providing a flexible plastic disposable article which effectively removes particulate matter from material surfaces such as clothing and which can be purchased by a traveler at minimal cost or provided among the toiletry items supplied to guests by many hotels.

SUMMARY OF THE INVENTION

The present invention relates to a disposable cleaning article having a first plastic sheet with inner and outer surfaces and a second plastic sheet having first and second surfaces. The first and second plastic sheets are similar in shape and cooperatively aligned with the second surface of the disposable cleaning article affixed along the periphery thereof to the inner surface of the first plastic sheet thereby forming an envelope or pocket area between the first and second plastic sheets. The affixed first and second plastic sheets include at least one opening to provide access to the pocket area. More specifically, the preferred embodiment employs generally rectangular first and second plastic sheets which are heat sealed to each other along the periphery of all four corresponding sides of each plastic sheet. To provide access to the pocket area an opening between the plastic sheets is provided by a slit formed in the first plastic sheet along either the height or width of the sheet proximate the periphery of the sheet. The slit divides the disposable cleaning article into a handle section and a surface cleaning section.

To remove particulate matter from material surfaces, the outer surface of the first plastic sheet is coated with an adhesive material. The adhesive material is both effective for removing fibrous debris such as lint and resistant to separating from the plastic sheet when the cleaning article frictionally contacts the surface to be cleaned. A protective cover is detachably secured to the adhesive material to protect the adhesive material prior to use of the article.

In the preferred embodiment of the present invention the first and second plastic sheets are polyethylene and the protective cover is paper. The preferred adhesive coating on the first plastic sheet is a mixture of a styrene isoprene copolymer and a partially esterfied natural resin.

These and other advantages and features of novelty which characterize the invention are pointed out with particularity in the claims annexed hereto and forming a part hereof. However, for a better understanding of the invention, its advantages, and objects attained by its use reference should be had to the drawings which form a further part hereof, and to the accompanying descriptive matter in which there is illustrated and described a preferred embodiment of the invention.

BRIEF DESCRIPTION OF THE DRAWINGS

In the drawings, like reference numerals indicate corresponding parts throughout the several views.

FIG. 1 is a top perspective view of a disposable cleaning article according to the present invention;

FIG. 2 is a bottom plan view thereof;

FIG. 3 is a top perspective view of a disposable cleaning article according to the present invention when the cavity thereof is occupied;

FIG. 6 is a sectional view taken along line 6—6 of FIG. 4;

FIG. 7 is a sectional view taken along line 7—7 of FIG. 4;

FIG. 8 is a bottom plan view of a disposable cleaning article according to the present invention with the protective cover partially detached therefrom; and FIG. 9 is an enlarged fragmentary view of the present invention as shown in FIG. 6.

DETAILED DESCRIPTION OF A PREFERRED EMBODIMENT

Figure 4:
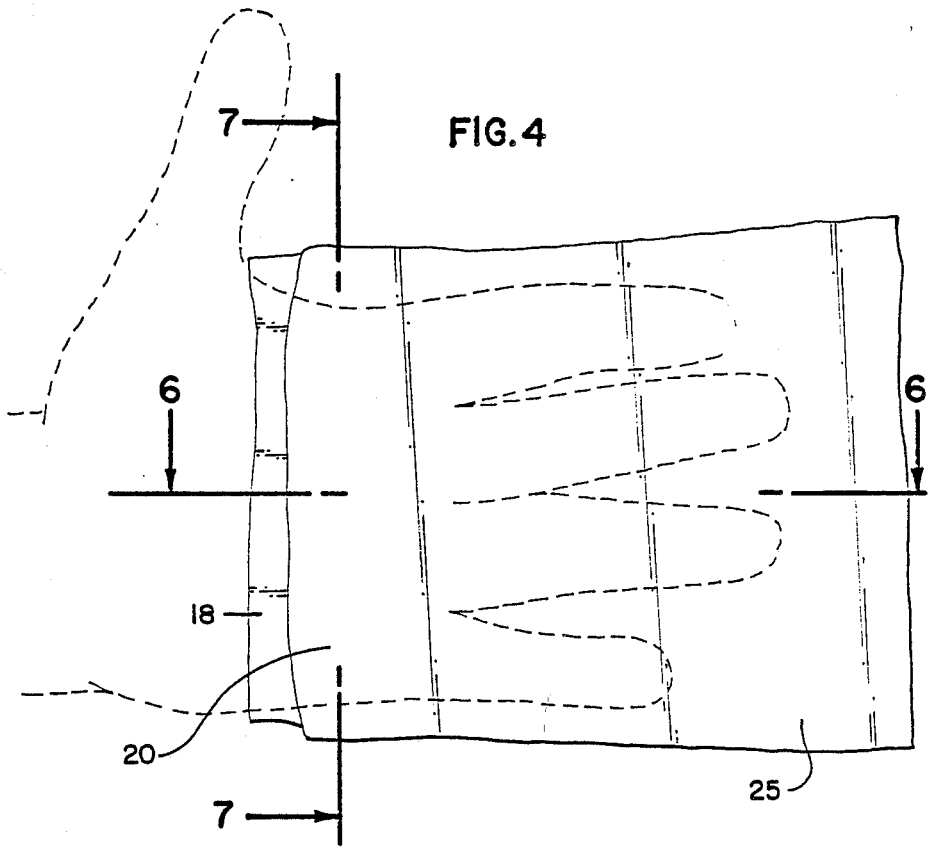
FIG. 4 is a bottom plan view of a disposable cleaning article showing the design of the present invention when the cavity thereof is occupied.
Figure 5:
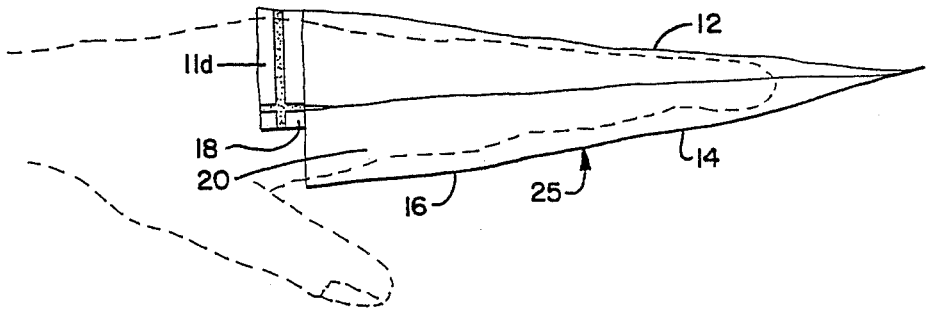
FIG. 5 is a side view of a disposable cleaning article according to the present invention when the cavity thereof is occupied.

Referring now to the drawings, there is shown in FIGS. 1 through 9 a preferred embodiment of the present invention generally referred to by the reference number 10. As is illustrated, in the preferred embodiment of the present invention, two similarly shaped sheets of plastic material 12, 14 are aligned and affixed to each other along the periphery 11*a–d* of the plastic sheets 12, 14 to form an article which defines an envelope or pocket 20. The outer surface 19 of one sheet is coated with an adhesive material 30 with the first or outer surface 33 of the other plastic sheet 12 providing an area for printed matter. The affixed first 14 and second 12 sheets have at least one slit or opening 17 to provide access to the pocket area 20. To protect the adhesive coated outer surface 19 a cover sheet 25 is detachably secured to the adhesive material 30.

More particularly, in the preferred embodiment, the plastic sheets 12, 14 are generally four-sided. As shown best in FIGS. 1–4, the plastic sheets 12, 14 are most preferably rectangular in shape. Referring to FIGS. 7 and 9, the first plastic sheet 14, has an inner surface 21 and an outer surface 19. The second plastic sheet 12 has a first surface 33 and a second surface 23. It is to be understood that formation of pocket 20 requires that the first sheet 14 and second sheet 12 be sealed along at least two opposite sides of the periphery (11*a* and 11*c* or 11*b* and 11*d*) of the two sheets 12, 14. In the preferred embodiment the first sheet 14 and second sheet 12 are aligned and sealed along all dimensions of the length and width. Specifically, as seen best in FIGS. 3, 5–7 and 9, inner surface 21 and second surface 23 are affixed along the outer periphery or edges 11*a–d* of each side of plastic sheets 12, 14. While first sheet 14 and second sheet 12 can be affixed to each other using a wide range of sealing techniques including various glues, in the preferred embodiment the first 14 and second 12 sheets are heat sealed 13 as best seen in FIGS. 1 and 3.

In order to provide access to pocket 20 for the hand of a user of the cleaning article 10, at least one opening through the first sheet 14 or second sheet 12 is needed. In the preferred embodiment the first sheet 14 includes a slit 17 along one planer dimension of the sheet 14 proximate the periphery 11*d*. Referring to FIG. 2, the slit 17 provides an opening to pocket 20 and divides the first plastic sheet 14 into two sections 16, 18. Specifically, slit 17 divides first sheet 14 into a cleaning surface area 15 and a handle 18.

Various plastic film materials are suitable for use in the present invetion. Useful plastic materials include polyvinyl chloride, polyethylene, polypropylene, polystyrene and urea-formaldehyde. In the preferred embodiment, the plastic sheets 12, 14 are polyethylene. While the film thickness of the plastic sheets 12, 14 can vary, in the preferred embodiment film thicknesses of between 0.001 and 0.004 inches are preferred. Most preferably, polyethylene sheets 12, 14 are about $0.002 \pm 0.0001$ inches thick.

According to the present invention, the outer surface 19 of the first sheet 14 is coated with an adhesive material 30 which is suitable for collecting particulate matter and resistant to separation or removal from the outer surface 19 when the cleaning article frictionally contacts the surface to be cleaned. While the specific composition of the adhesive material can be varied by one of skill in the art the preferred adhesive material is a mixture of styrene isoprene copolymer and a partially esterfied natural resin. Examples of useful natural resin material include hydrogenated colophony and wood resin.

A preferred embodiment of the present invention employs a plastic first sheet 14 and hot melt base glue 30 commerically available from Artin Kores AB, Hanholmsvagen 51, 60222 Norrkoping as Polyeten and Hernia 8655, respectively.

Figure 10:
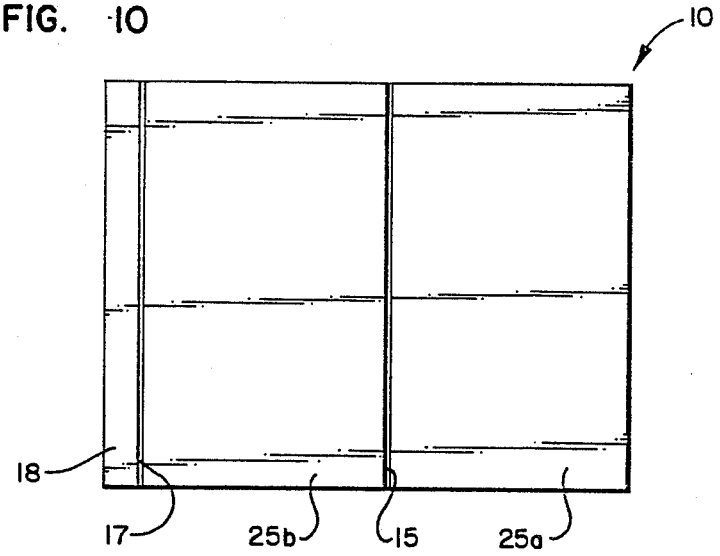
FIG. 10 is a bottom plan view of an alternate embodiment of the present invention.

In order to protect the integrity of the cleaning article 10 prior to use and maximize the particulate matter collecting ability of the adhesive material 30 the cleaning article 10 is provided with cover means 25 compatable with and detachably secured to the adhesive material 30. In the preferred embodiment, the cover material 25 is a fibrous material, most preferably, paper. Detachment of the paper cover 25 is facilitated by slit 17 which penetrates through cover 25. As shown in FIG. 10, in an alternate embodiment a second slit 15 is provided which penetrates through cover 25 only to facilitate removal of cover 25 in separate pieces 25*a*,25*b*.

It is to be understood that the present invention can be made utilizing a number of methods known to one of skill in the art. One preferred manufacturing process involves bringing separate bolts of previously prepared polyethylene material into contact with each other followed by heat sealing and formation of an opening in the joined material. Specifically, one web of polyethylene corresponding to sheet 12 is brought into contact with a web of polyethylene material corresponding to sheet 14. Sheet 12 can be pre-printed on the first surface 33 with desired material such as the trademark or logo of the provider of the finished cleaning article 10. Sheet 14 preferably includes adhesive 30 and cover 25 on the outer surface 19 thereof. The two polyethylene sheets 12, 14 are aligned and heat sealed at the periphery 11*a–d* along each side of the article 10 followed by cutting slit 17 in sheet 14 to provide an opening to pocket area 20.

The present invention 10 provides an inexpensive and effective disposable cleaning article 10 for removing particulate matter such as lint from clothing. Use of the cleaning article 10 is best described referencing FIGS. 3–5. Specifically, to use cleaning article 10 an individual merely inserts a hand through opening 17 and detaches the protective covering 25 to expose the adhesive material 30. The adhesive 30 bearing surface 19 is brought into contact with the article of clothing or other material. To remove particulate matter the user manually moves the article 10 across the surface of the material to be cleaned. It will be appreciated that the structural configuration of the present invention 10 allows the adhesive 30 coated surface 19 to conform in shape to the material to be cleaned thereby maximizing the ability of the cleaning article 10 to remove the particulate matter from the surface to be cleaned. When the embodiment including the double cut 15, 17, cover 25 (FIG. 10) is employed, the portion of the adhesive 30 coated outer surface 19 protected by cover segment 25*a* can be used independently of the portion of surface 19 protected by cover segment 25*b*.

It is to be understood, however, that even though numerous advantages and characteristics of the invention have been set forth in the foregoing description, together with details of the structure and function of the invention, the disclosure is illustrative only and changes may be made in detail, especially in matters of shape and size of the parts within the principal of the invention to the full extent indicated by the broad general meaning of the terms of which the appended claims are expressed.

What is claimed is:

1. A disposable cleaning article comprising:

(a) first plastic sheet having inner and outer surfaces, said outer surface coated with an adhesive material suitable for collecting particulate matter;

(b) a second plastic sheet overlaying and aligned with said first plastic sheet and having first and second surfaces, said second plastic sheet affixed along the periphery thereof to said first plastic sheet, thereby forming a pocket area between said first and second plastic sheets, access to said pocket being provided by a slit in said first sheet along one dimension of said article proximate the periphery, said slit dividing said affixed first and second sheets into a handle section and a surface cleaning section; and (c) cover means detachably secured to said adhesive material.

2. The disposable cleaning article of claim 1 wherein said first and second plastic sheets are polyethylene.

3. The disposable cleaning article of claim 1 wherein said cover mean comprises a sheet of fibrous material.

4. The disposable cleaning article of claim 3 wherein said cover means comprises paper.

5. The disposable cleaning article of claim 1 wherein said first and second plastic sheets are generally rectangular and heat sealed to each other along at least two opposing sides.

6. The disposable cleaning article of claim 5 wherein said first and second plastic sheets are heat sealed along all four sides.

7. The disposable cleaning article of claim 1 wherein said adhesive is a mixture of a styrene isoprene copolymer and a partially esterfied natural resin which is resistant to friction induced separation from said outer surface.

8. A disposable cleaning article comprising:

(a) a generally four-sided first plastic sheet having inner and outer surfaces, said outer surface coated with an adhesive material suitable for collecting particulate matter, said adhesive coating resistent to friction induced separation from said outer surface;

(b) a generally four-sided second plastic sheet overlaying and aligned with said first plastic sheet and having first and second surfaces, said second surface affixed to said inner surface of said first sheet along the periphery of at least two opposing sides of said aligned first and second sheets, thereby forming a pocket area between said first and second plastic sheets, access to said pocket formed by said first and second plastic sheets provided by an opening defined by a slit in said first sheet, said slit proximate the periphery and being between opposing affixed sides of said first and second sheets, said slit dividing said affixed first and second sheets into a handle section and a surface cleaning section; and (c) a sheet of fibrous material compatible with and detachably secured to said adhesive material.

9. The disposable cleaning article of claim 8 wherein said first and second plastic sheets are heat sealed along all four sides.

10. The disposable cleaning article of claim 9 wherein said first and second plastic sheets are polyethylene.

11. The disposable cleaning article of claim 10 wherein said first and second plastic sheets are between 0.001 and 0.004 inches in thickness.

12. The disposable cleaning article of claim 8 wherein said cover means comprises paper.

13. The disposable cleaning article of claim 8 wherein said adhesive material comprises a mixture of styrene isoprene copolymer and a partially esterfied natural resin.

14. The disposable cleaning article of claim 8 wherein said first surface of said second plastic sheet includes printed matter.

15. The disposable cleaning article of claim 9 wherein said sheet of fibrous material includes a pair of substantially parallel cuts along either the height or width thereof, said cuts dividing said cover into segments protecting said handle section and first and second surface cleaning sections of said outer surface.

* * * * *